US009443466B2

(12) United States Patent
In et al.

(10) Patent No.: US 9,443,466 B2
(45) Date of Patent: Sep. 13, 2016

(54) ORGANIC LIGHT EMITTING DIODE DISPLAY DEVICE HAVING REPAIR CIRCUIT COUPLED TO PIXELS OF THE DISPLAY DEVICE

(71) Applicant: Samsung Display Co., Ltd., Yongin, Gyeonggi-do (KR)

(72) Inventors: Hai-Jung In, Yongin (KR); Yong-Sung Park, Yongin (KR); Yong-Jae Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 254 days.

(21) Appl. No.: 13/954,750

(22) Filed: Jul. 30, 2013

(65) Prior Publication Data

US 2014/0313106 A1 Oct. 23, 2014

(30) Foreign Application Priority Data

Apr. 22, 2013 (KR) ..... 10-2013-0044232

(51) Int. Cl.
*G09G 3/32* (2016.01)

(52) U.S. Cl.
CPC ..... *G09G 3/3233* (2013.01); *G09G 3/3291* (2013.01); *G09G 2300/0819* (2013.01); *G09G 2300/0852* (2013.01); *G09G 2300/0861* (2013.01); *G09G 2310/0262* (2013.01); *G09G 2310/0297* (2013.01); *G09G 2310/063* (2013.01); *G09G 2320/043* (2013.01); *G09G 2330/08* (2013.01)

(58) Field of Classification Search
None
See application file for complete search history.

(56) References Cited

U.S. PATENT DOCUMENTS

2003/0042482 A1 3/2003 Jun et al.
2007/0040794 A1* 2/2007 Kwak ..... G02F 1/136259 345/100
2007/0205974 A1* 9/2007 Iizuka ..... G09G 3/3648 345/98
2007/0262934 A1* 11/2007 Fujikawa ..... G06K 15/1209 345/82
2009/0015572 A1* 1/2009 Matsui ..... G09G 3/006 345/204
2010/0044691 A1 2/2010 Hong et al.
2010/0207106 A1 8/2010 Lhee et al.
2012/0120036 A1* 5/2012 Yamashita ..... G09G 3/3233 345/205
2012/0146034 A1 6/2012 Hong et al.
2012/0300165 A1* 11/2012 Zhuang ..... G02F 1/136259 349/139

FOREIGN PATENT DOCUMENTS

KR 10-2003-0018620 A 3/2003
KR 10-2006-0005012 A 1/2006
KR 10-2008-0063611 A 7/2008
KR 10-0932989 B1 12/2009
KR 10-1022156 B1 3/2011
KR 10-1156447 B1 6/2012

* cited by examiner

*Primary Examiner* — David D Davis
(74) *Attorney, Agent, or Firm* — Knobbe Martens Olson & Bear LLP

(57) ABSTRACT

An organic light emitting diode (OLED) display device includes a plurality of pixels each having a pixel circuit and an organic light emitting diode coupled to the pixel circuit. The OLED display device includes a scan driver which is configured to supply a scan signal to the scan lines and to supply an emission control signal to an emission control line commonly coupled to the pixels. The OLED display device also includes repair lines and repair circuits coupled to the repair lines. The repair circuits each have an output terminal coupled to an organic light emitting diode in corresponding pixel. A switching unit is configured to allow output lines of the data driver to be selectively coupled to the repair lines or the data lines.

18 Claims, 7 Drawing Sheets

15659675
062413

ORGANIC LIGHT EMITTING DIODE DISPLAY DEVICE HAVING REPAIR CIRCUIT COUPLED TO PIXELS OF THE DISPLAY DEVICE

CROSS REFERENCE TO RELATED APPLICATIONS

This application claims priority to and the benefit of Korean Patent Application No. 10-2013-0044232, filed on Apr. 22, 2013, in the Korean Intellectual Property Office, the entire contents of which are incorporated herein by reference in their entirety. Any and all applications for which a foreign or domestic priority claim is identified in the Application Data Sheet as filed with the present application are hereby incorporated by reference under 37 CFR 1.57.

BACKGROUND

1. Field

The present disclosure relates to an organic light emitting diode (OLED) display device and a driving method thereof.

2. Description of the Related Technology

Recently, there have been developed various types of flat panel display devices capable of reducing the weight and volume of cathode ray tubes. Current flat panel display devices include liquid crystal display devices, field emission display devices, plasma display panels, OLED display devices, and the like.

Among these flat panel display devices, the OLED display device displays images using organic light emitting diodes that emit light through recombination of electrons and holes. The OLED display device has a fast response speed and is driven with low power consumption.

SUMMARY

Embodiments provide an OLED display device having a repair circuit(s) configured to preparation for a pixel defect(s) and a driving method of the OLED display device.

In one aspect an organic light emitting diode display device comprises a plurality of pixels positioned at intersection portions of scan lines and data lines, the plurality of pixels each having a pixel circuit and an organic light emitting diode coupled to the pixel circuit; a scan driver configured to supply a scan signal to the scan lines and supply an emission control signal to a common emission control line coupled to the pixels; a control driver configured to supply a first control signal to a first common control line coupled to the pixels and supply a second control signal to a second common control line commonly coupled to the pixels; a data driver configured to supply a data signal to the data lines; repair lines arranged in parallel to the data lines; repair circuits coupled to the repair lines, the repair circuits each having an output terminal coupled to an organic light emitting diode in one or more corresponding pixels; and a switching unit configured to selectively couple the data driver to the repair lines or the data lines.

In some embodiments, the organic light emitting diode provided in each pixel is configured to be selectively coupled to the pixel circuit or a corresponding repair circuit via a coupling portion.

In some embodiments, each repair circuit includes: a first transistor having a first electrode thereof coupled to a first pixel power source, and a second electrode thereof coupled to the output terminal; a first capacitor coupled between a gate electrode of the first transistor and a repair line; a second transistor having a first electrode thereof coupled to a coupling node between the gate electrode of the first transistor and the first capacitor, a second electrode thereof coupled to the repair line, and a gate electrode thereof coupled to the first control line; and a third transistor having a first electrode thereof coupled to the coupling node between the gate electrode of the first transistor and the first capacitor, a second electrode thereof coupled to the second electrode of the first transistor, and a gate electrode thereof coupled to the second control line.

In some embodiments, the pixel circuit provided in each pixel includes: a fourth transistor having a first electrode thereof coupled to a data line, a second electrode thereof coupled to a first node, and a gate electrode thereof coupled to a scan line; a second capacitor coupled between the first node and the initialization power source; a fifth transistor having a first electrode thereof coupled to the first node, a second electrode thereof coupled to a second node, and a gate electrode thereof coupled to the second control line; a sixth transistor having a first electrode thereof coupled to the first pixel power source, a second electrode thereof coupled to the second node, and a gate electrode thereof coupled to the first control line; a seventh transistor having a first electrode thereof coupled to the first pixel power source, a second electrode thereof coupled to the second node, and a gate electrode thereof coupled to the emission control line; a third capacitor coupled between the first pixel power source and a third node; an eighth transistor having a first electrode thereof coupled to the second node, a second electrode thereof coupled to a fourth node, and a gate electrode thereof coupled to the third node; a ninth transistor having a first electrode thereof coupled to the third node, a second electrode thereof coupled to the initialization power source, and a gate electrode thereof coupled to the first control line; and a tenth transistor having a first electrode thereof coupled to the fourth node, a second electrode thereof coupled to the third node, and a gate electrode thereof coupled to the second control line.

In some embodiments, the organic light emitting diode provided in each pixel is configured to be selectively coupled to a pixel circuit in the corresponding pixel or a corresponding repair circuit via a coupling portion, and wherein each pixel includes: an eleventh transistor coupled between the coupling portion and the organic light emitting diode, the eleventh transistor having a gate electrode coupled to the emission control line; and a twelfth transistor coupled between the first control line and a coupling node between the eleventh transistor and the organic light emitting diode, the twelfth transistor having a gate electrode coupled to the first control line so as to be diode-coupled.

In some embodiments, the control driver supplies a first control signal during a first period in a frame, and supplies a second control signal during a second period which is subsequent to the first period.

In some embodiments, the scan driver is configured to turn off the seventh and eleventh transistors by supplying the emission control signal during the first and second periods, and is further configured to stop the emission control signal during a third period, which is subsequent to the first and second periods. The scan driver is further configured to progressively supply a scan signal to the scan lines during a fourth period which is subsequent to the third period.

In some embodiments, the switching unit is configured to couple the output lines of the data driver to the repair lines during the second and third periods, and is further configured to couple the output lines to the data lines during the fourth period.

In some embodiments, the data driver is configured to output a data signal of the pixel coupled to the repair line during the second period, and a reference voltage during the third period.

In some embodiments, the data driver is configured to output the data signal during the fourth period.

In some embodiments, the switching unit is further configured to couple the output lines of the data driver to the repair lines during the first period.

In some embodiments, the data driver outputs the voltage of the initialization power source during the first period.

In some embodiments, the organic light emitting diode provided in each pixel is configured to be selectively coupled to a pixel circuit in the corresponding pixel or a corresponding repair circuit via a coupling portion, wherein the pixel circuit further includes an eleventh transistor coupled between the fourth node and the coupling portion, the eleventh transistor having a gate electrode coupled to the emission control line, and wherein the repair circuit further includes a thirteenth transistor coupled between the second electrode of the first transistor and the coupling portion, the thirteenth transistor having a gate electrode coupled to the emission control line.

In some embodiments, each pixel further includes a twelfth transistor coupled between the first control line and a coupling node between the coupling node and the organic light emitting diode, the twelfth transistor having a gate electrode coupled to the first control line so as to be diode-coupled.

In some embodiments, the pixel circuit further includes a twelfth transistor coupled between the second electrode of the eleventh transistor and the first control line, the twelfth transistor having a gate electrode coupled to the first control line so as to be diode-coupled, and wherein the repair circuit further includes a fourteenth transistor coupled between the repair line and a coupling node between the coupling portion and the thirteenth transistor, the fourteenth transistor having a gate electrode coupled to the first control line.

In some embodiments, each of the repair circuits corresponds to one of the pixels and is arranged adjacent to the corresponding pixels.

In some embodiments, the repair circuits are arranged so that each of the repair circuits corresponds to a plurality of pixels.

In another aspect, a method of driving an organic light emitting diode display in which a defect occurs in a pixel circuit, comprises: cutting off a current path between the repair circuit and the organic light emitting diode by supplying an emission control signal during a non-emission period of the pixel; supplying the voltage of an initialization power source to a gate electrode of a first transistor in a repair circuit corresponding to the pixel circuit by supplying a first control signal to a gate electrode of a second transistor in the repair circuit, wherein supplying the first control signal occurs during a first period; supplying and storing a data signal of the pixel into the repair circuit by supplying a second control signal to a third transistor in the repair circuit during a second period, which subsequent to the first period; and forming a current path between the repair circuit and the organic light emitting diode by stopping the supply of the emission control signal during an emission period of the pixel.

In some embodiments, source reference voltage is supplied to the repair circuit during a third period, the third period being part of the emission period.

In some embodiments, data signals are supplied to the pixels while a scan signal is progressively supplied to the scan lines during a fourth period, which is subsequent to the third period and is part of the emission period.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
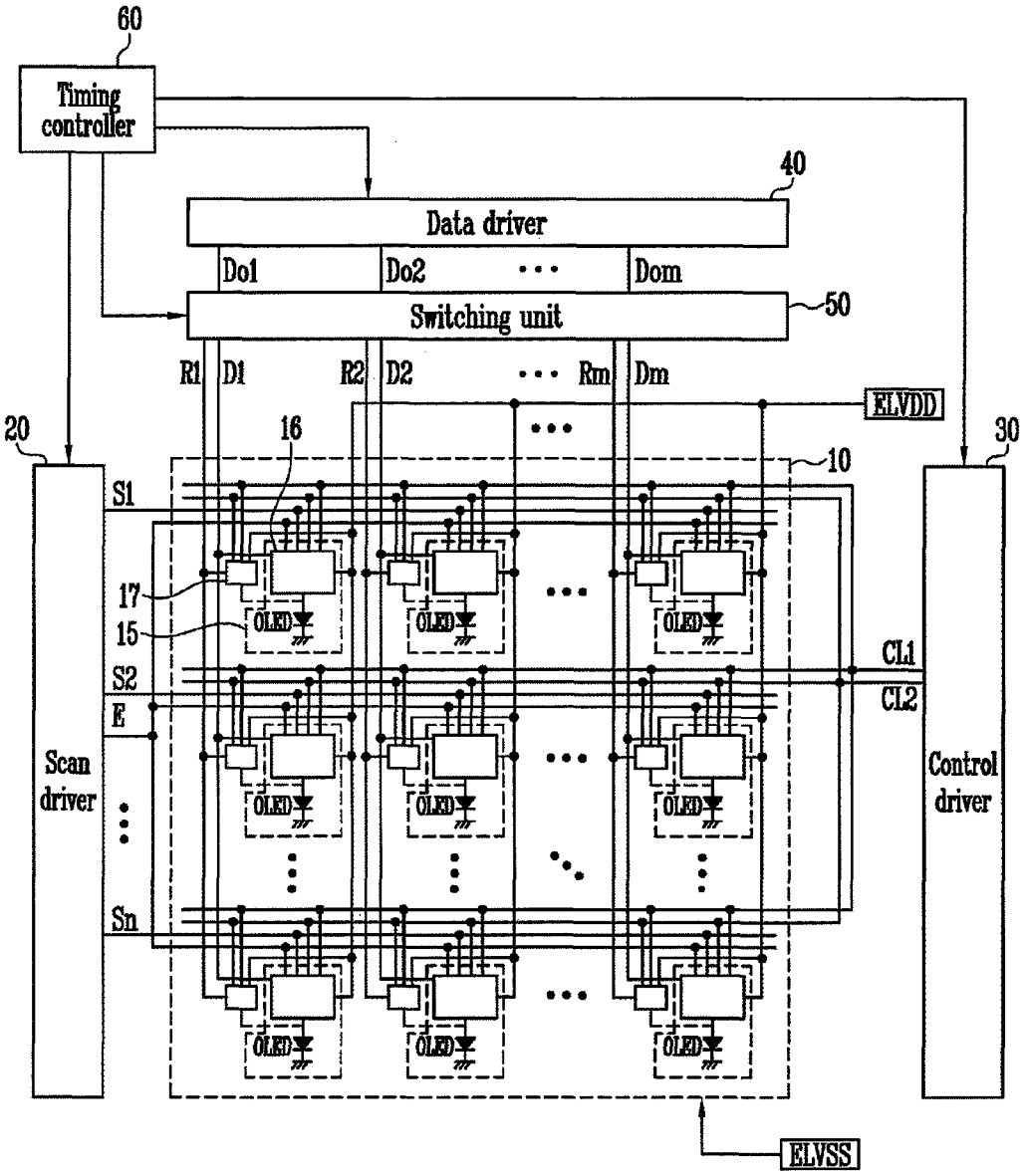
FIG. 1 is a block diagram illustrating an embodiment of an OLED display device.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, except where otherwise indicated, like reference numerals refer to like elements throughout.

FIG. 1 is a block diagram illustrating an embodiment of an OLED display device.

Referring to FIG. 1, the OLED display device includes a pixel unit 10 having a plurality of pixels 15 positioned at intersection portions of scan lines S1 to Sn and data lines D1 to Dm, a scan driver 20 configured to drive the scan lines S1 to Sn and an emission control line E, a control driver 30 configured to drive first and second control lines CL1 and CL2, a data driver 40 configured to drive the data lines D1 to Dm, a switching unit 50 disposed between the pixel unit 10 and the data driver 40. The OLED display device also includes a timing controller 60 configured to control the scan driver 20, the control driver 30, the data driver 40 and the switching unit 50. The OLED display device further includes repair lines R1 to Rm disposed in parallel to the data lines D1 to Dm, and repair circuits 17 coupled to the repair lines R1 to Rm.

As used herein, the term column may be used to refer to the pixels 15 which are positioned within the pixel unit 10 in a direction parallel to the direction of the data lines D1 through Dm. The term row may be used to refer to the pixels 15 which are positioned within the pixel unit 10 in a direction generally parallel to the direction of the scan lines S1 through Sn.

Although. FIG. 1 shows that one repair circuit 17 is coupled to each pixel 15, making an equal number of repair circuits 17 and pixels 15, the present invention is not limited thereto. In some embodiments, the repair circuits 17 are configured to supply a driving current to an OLED instead of to a pixel circuit 16 in which a defect occurs, in order to detect a defect which occurs in the pixel circuit 16. In some embodiments, the repair circuits 17 may be arranged so that one repair circuit 17 is coupled to a plurality of pixels 15. For example, one or more repair circuits 17 may be provided to detect or identify a defect(s) of a pixel circuit(s) 16 in the pixels 15 arranged in one column. In some embodiments, the repair circuits 17 may be coupled to the OLEDs in pixels 15 arranged on the same column or in adjacent columns. In some embodiments, the positions of the repair circuits 17 may be connected to the pixel circuit 16 or OLED of a variety of pixels 15, which need not necessarily be in the same column or row. In some embodiments, the repair circuits 17 may be provided in the pixel unit 10, or may be provided at an upper portion and/or a lower portion of the pixel unit 10.

Although FIG. 1 shows that the repair lines R1 to Rm are arranged such that one repair line R1 is parallel to one data line D1, the present invention is not limited thereto. For example, in some embodiments, a plurality of repair lines R and a plurality of repair circuits 17 may be arranged on each column in the pixel unit 10. In some embodiments, the plurality of repair circuits 17 drive the OLED, in place of a pixel circuit(s) 16 in which a defect(s) occur(s) with respect to the plurality of pixels 15 arranged on the same column, thereby allowing detection of and accounting for a pixel defect(s).

The pixel unit 10 includes a plurality of pixels 15 arranged in a matrix, each of the plurality of pixels 15 being disposed at an intersection of the scan lines S1 to Sn and the data lines D1 to Dm. Each pixel 15 includes a pixel circuit 16 with an OLED coupled thereto. The pixel unit 10 is driven by first and second pixel power sources ELVDD and ELVSS supplied from an external power circuit (not shown).

The OLED provided in each pixel 15 is operated by being coupled to the pixel circuit 16 in the corresponding pixel 15. In a pixel in which a defect occurs in the pixel circuit 16, the OLED is operated by being coupled to the repair circuit 17 which is coupled to the corresponding pixel 15.

In a case where a defect occurs in the pixel circuit 16, the repair circuit 17 provides driving current to the OLED, in place of the pixel circuit 16. Thus, where a defect occurs in the pixel circuit 16 the pixel 15, an output terminal of the repair circuit 17 is coupled to the OLED in the pixel 15. When the repair circuit is not supplying driving current to the OLED, the output terminal of the repair circuit 17 is floated.

The voltage of an initialization power source is transmitted to the repair circuit 17 by a first control signal supplied from the first control line CL1 during a first period, in which the pixels 15 are in a non-emission state. The data signal of the pixel 15 coupled to the repair circuit 17 is transmitted to the repair circuit 17 by a second control signal supplied from the second control line CL2 during a second period, which is subsequent to the first, non-emission period.

The voltage of a reference power source is transmitted to the repair circuit 17 during a third period, which is subsequent to the second period, and a data signal is transmitted to each pixel circuit 16 during a fourth period, which is subsequent to the third period. During the third and fourth periods Each pixel 15 emits light with a luminance corresponding to the data signal supplied and stored in the previous period. The configurations and operations of the pixels 15 and the repair circuit 17 will be described in detail later.

Figure 3:
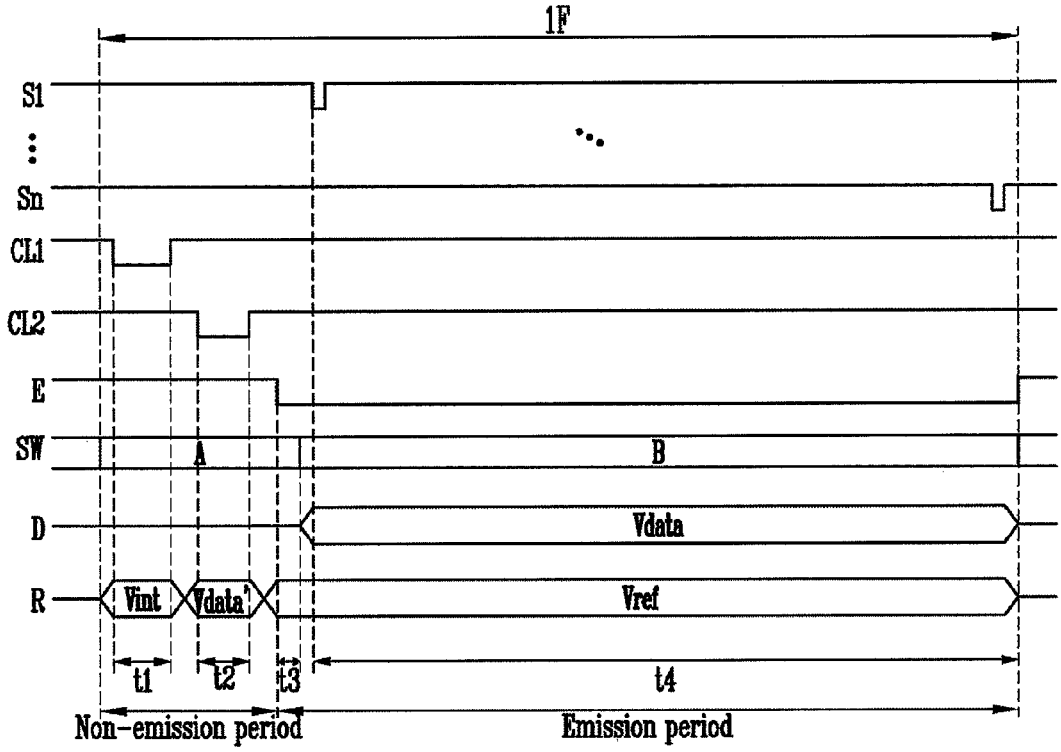
FIG. 3 is a waveform diagram illustrating a driving method of the pixel, the repair circuit and the switching unit shown in FIG. 2.

The scan driver 20 supplies a scan signal to the scan lines S1 to Sn. and the scan driver 20 also supplies an emission control signal to the emission control line E, which is commonly coupled to all the pixels 15. For example, the scan driver 20, as shown in FIG. 3, may progressively supply a scan signal to the scan lines S1 to Sn during the fourth period t4 in the first frame 1F, and may supply an emission control signal to the emission control line E during the first and second periods t1 and t2. Here, the scan signal supplied from the scan driver 20 is set to a voltage (e.g., a low voltage) at which transistors included in the pixel circuit 16 are turned on, and the emission control signal supplied from the scan driver 20 is set to a voltage (e.g., a high voltage) at which the transistors are turned off. This operation will be described in greater detail below.

The control driver 30 supplies a first control signal to the first control line CL1, which is commonly coupled to the pixels 15, and supplies a second control signal to the second control line CL2, which is also commonly coupled to the pixels 15. Here, the first and second control signals are supplied not to overlap with each other in the first, non-emission period of the pixels 15.

The data driver 40 supplies a data signal to the data lines D1 to Dm so as to be synchronized with the scan signal supplied to the scan lines S1 to Sn.

The switching unit 50 is disposed between the pixel unit 10 and the data driver 40, so as to allow output lines Do1 to Dom of the data driver 40 to be selectively coupled to the repair lines R1 to Rm or the data lines D1 to Dm. To this end, the switching unit 50 may include a plurality of switches coupled between the output lines Do1 to Dom of the data driver 40 and the repair lines R1 to Rm and data lines D1 to Dm. For example, in some embodiments, the switching unit 50, allows the output lines Do1 to Dom of the data driver 40 to be coupled to the repair lines R1 to Rm during the first to third periods t1 to t3 under the control of the timing controller 60, and may allow the output lines Do1 to Dom of the data driver 40 to be coupled to the data lines D1 to Dm during the fourth period t4 under the control of the timing controller 40.

The timing controller 60 controls operations of the scan driver 20, the control driver 30, the data driver 40 and the switching unit 50 while supplying control signals to the scan driver 20, the control driver 30, the data driver 40 and the switching unit 50. In addition, the timing controller 60 transmits data supplied from the outside of the OLED display panel to the data driver 40.

In some embodiments, the OLED display device includes repair circuits 17 configured to supply driving current to an OLED, rather than to the pixel circuit 16 in a pixel 15 in which a defect occurs. Accordingly, the corresponding pixel 15 can emit light with a desired luminance even when a defect occurs in the pixel circuit 16, thereby improving the output or display of the OLED display device.

Moreover, in some embodiments, the repair circuit 17 has a first transistor configured to supply driving current to the OLED and transistors configured to compensate for a threshold voltage of the first transistor and a voltage drop of the first pixel power source ELVDD, thereby improving the image quality of the OLED display device.

The repair circuit 17 and its operation in the OLED display device according to embodiments of the present invention will be described in detail with reference to FIGS. 2 to 7.

Figure 2:
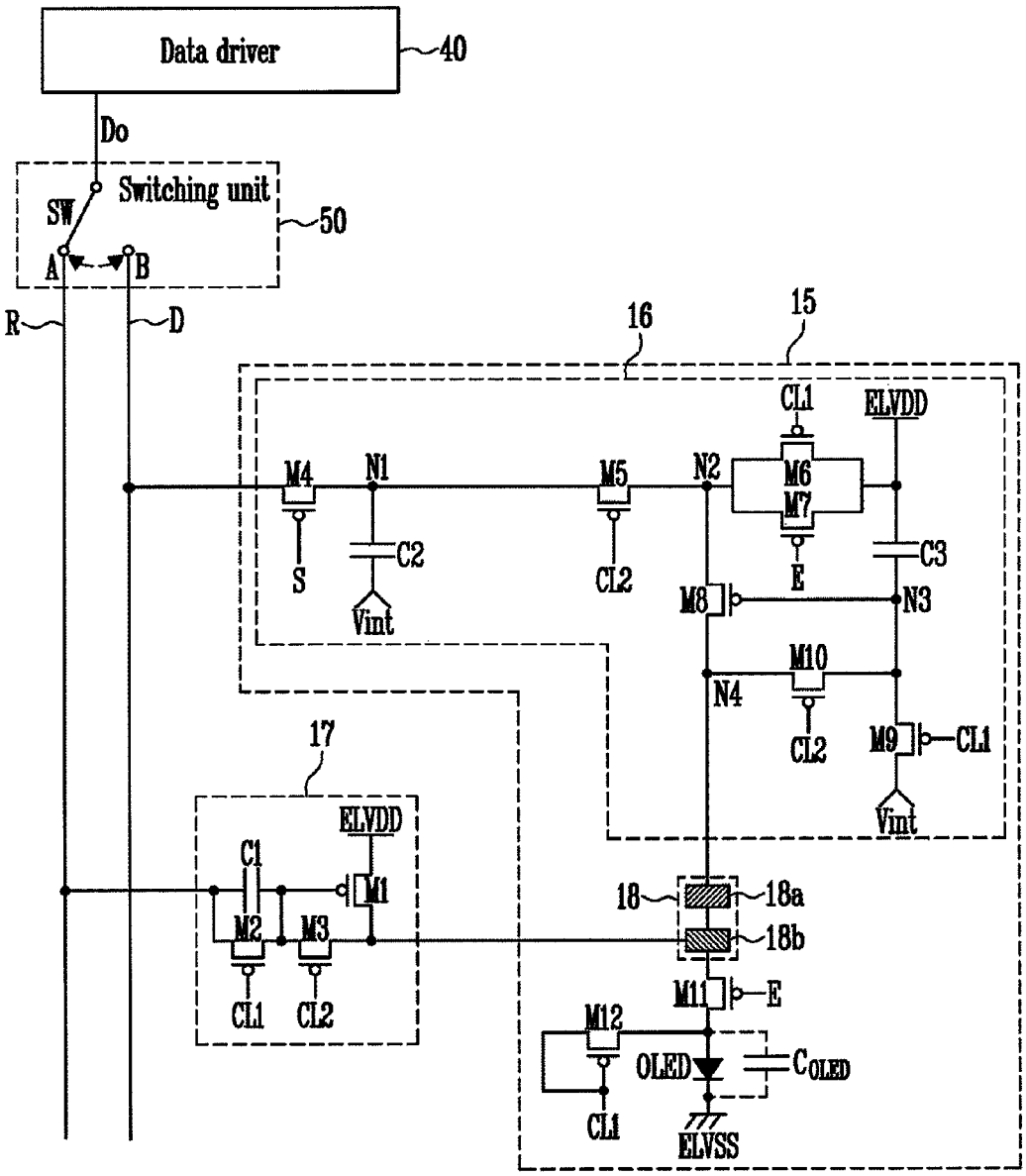
FIG. 2 is a circuit diagram illustrating an embodiment of a pixel, a repair circuit and a switching unit, shown in FIG. 1.

FIG. 2 is a circuit diagram illustrating an embodiment of the pixel, the repair circuit and the switching unit, shown in FIG. 1. For convenience, only one pixel and a corresponding repair circuit and a switch are shown in FIG. 2. However, in some embodiments, a plurality of repair lines and a plurality of repair circuits may be provided in the pixel unit 10, and a plurality of switches configured to allow each output line of the data driver 40 to be selectively coupled to a data line D1, D2, . . . Dm or repair line R1, R2, Rm on a corresponding column may be provided in the switching unit 50.

Referring to FIG. 2, the switching unit 50 has a switch SW configured to allow an output line Do of the data driver 40 to be selectively coupled to either a repair line R or data line D.

The repair circuit 17 includes a first transistor M1, a second transistor M2, a third transistor M3, and a first capacitor C1.

A first electrode of the first transistor M1 is coupled to the first pixel power source ELVDD, and a second electrode of the first transistor M1 is coupled to an output terminal of the repair circuit 17. A gate electrode of the first transistor M1 is coupled to one terminal of the first capacitor C1. The first and second electrodes are set as different electrodes, meaning, for example, that if the first electrode is the source electrode, the second electrode is the drain electrode, and vice versa.

The output terminal of the repair circuit 17 may be coupled to a coupling portion 18, which is disposed between the pixel circuit 16 and the OLED. For example, in a case where a defect occurs in the pixel circuit 16, the coupling between the pixel circuit 16 and the organic light emitting diode OLED may be cut off in a cutting region 18*a* of the coupling portion 18, and the repair circuit 17 and the OLED may be coupled to each other in a coupling region 18*b* of the coupling portion 18.

That is, the OLED may be coupled to the pixel circuit 16 in the corresponding pixel 15 via the coupling portion 18, or the OLED may be coupled to the repair circuit 17 corresponding to the pixel 15. The organic light emitting diode OLED and the repair circuit 17 may be directly coupled to each other, or may be coupled to each other via another circuit device. For example, in some embodiments, an eleventh transistor M11 is coupled between the OLED and the repair circuit 17.

If the first transistor M1 is coupled to the OLED, the first transistor M1 supplies to the OLED, driving current corresponding to the voltage supplied to the gate electrode of the first transistor M1.

The first capacitor C1 is coupled between the gate electrode of the first transistor M1 and the repair line R on the corresponding column. The first capacitor C1 charges to a voltage corresponding to the data signal supplied to the repair line R.

A first electrode of the second transistor M2 is coupled to a coupling node between the gate electrode of the first transistor M1 and the first capacitor C1, and a second electrode of the second transistor M2 is coupled to the repair line R. A gate electrode of the second transistor M2 is coupled to the first control line CL 1. The second transistor M2 transmits the voltage of the initialization power source, supplied when the first control signal is supplied to the first control line CL1, to the coupling node between the gate electrode of the first transistor M1 and the first capacitor C1.

A first electrode of the third transistor M3 is coupled to the coupling node between the gate electrode of the first transistor M1 and the first capacitor C1, and a second electrode of the third transistor M3 is coupled to the second electrode of the first transistor M1. A gate electrode of the third transistor M3 is coupled to the second control line CL2. The third transistor M3 allows the first transistor M1 to be diode-coupled when the second control signal is supplied to the second control line CL2.

As discussed above, the pixel 15 includes the OLED configured to generate light, and the pixel circuit 16 is configured to supply driving current to the OLED.

An anode of the OLED is coupled to the pixel circuit 16 in the corresponding pixel 15 and/or the repair circuit 17 adjacent to the pixel 15 through the coupling portion 18. A cathode electrode of the OLED is coupled to the second pixel power source ELVSS. The OLED emits light with a luminance corresponding to the driving current supplied from the pixel circuit 16 or the repair circuit 17.

The pixel circuit 16 includes fourth to tenth transistors M4 to M10, and second and third capacitors C2 and C3. The pixel circuit 16 charges a voltage corresponding to the data signal supplied to the data line D when a scan signal is supplied to a scan line S, and supplies, to the OLED, driving current corresponding to the data signal during an emission period of the pixel 15.

A first electrode of the fourth transistor M4 is coupled to the data line D on the corresponding column, and a second electrode of the fourth transistor M4 is coupled to a first node N1. A gate electrode of the fourth transistor M4 is coupled to the scan line S which corresponds to the row in which the pixel 15 is positioned. The fourth transistor M4 is turned on when the scan signal is supplied to the scan line S, so as to transmit a data signal from the data line D to the first node N1.

The second capacitor C2 is coupled between the first node N1 and a fixed voltage source, such as an initialization power source Vint). The second capacitor C2 can be charged a voltage corresponding to the data signal transmitted from the fourth transistor M4.

A first electrode of the fifth transistor M5 is coupled to the first node N1, and a second electrode of the fifth transistor M5 is coupled to a second node N2. A gate electrode of the fifth transistor M5 is coupled to the second control line CL2. The fifth transistor M5 is turned on when the second control signal is supplied to the second control line CL2, so as to allow the first and second nodes N1 and N2 to be electrically coupled to each other.

A first electrode of the sixth transistor M6 is coupled to the first pixel power source ELVDD, and a second electrode of the sixth transistor M6 is coupled to the second node N2. A gate electrode of the sixth transistor M6 is coupled to the first control line CL1. The sixth transistor M6 is turned on when the first control signal is supplied to the first control line CL1, so as to supply the voltage of the first pixel power source ELVDD to the second node N2.

A first electrode of the seventh transistor M7 is coupled to the first pixel power source ELVDD, and a second electrode of the seventh transistor M7 is coupled to the second node N2. A gate electrode of the seventh transistor M7 is coupled to the emission control line E. The seventh transistor M7 is turned of when an emission control signal is supplied to the emission control line E, and is turned on when the emission control signal is not supplied to the emission control line E, so as to supply the voltage of the first pixel power source ELVDD to the second node N2.

The third capacitor C3 is coupled between the first pixel power source ELVDD and a third node N3. The third capacitor C3 can be charged to a voltage corresponding to the data signal and the threshold voltage of the eighth transistor M8, corresponding to the voltage charged in the second capacitor C2.

A first electrode of the eighth transistor (driving transistor) M8 is coupled to the second node N2, and a second electrode of the eighth transistor M8 is coupled to a fourth node N4. A gate electrode of the eighth transistor M8 is coupled to the third node N3. The eighth transistor M8 controls the amount of driving current supplied to the OLED, corresponding to the voltage applied to the third node N3.

A first electrode of the ninth transistor M9 is coupled to the third node N3, and a second electrode of the ninth transistor M9 is coupled to the initialization power source Vint. A gate electrode of the ninth transistor M9 is coupled to the first control line CL1. The ninth transistor M9 is turned on when the first control signal is supplied to the first control line CL1, so as to supply the voltage of the initialization power source Vint to the third node N3.

A first electrode of the tenth transistor M10 is coupled to the fourth node N4, and a second electrode of the tenth transistor M10 is coupled to the third node N3. A gate electrode of the tenth transistor M10 is coupled to the second control line CL2. The tenth transistor M10 is turned on when the second control signal is supplied to the second control line CL2, so as to allow the third and fourth nodes N3 and N4 to be electrically coupled to each other. If the third and fourth nodes N3 and N4 are electrically coupled to each other, the eighth transistor M8 is diode-coupled.

Each pixel 15 further includes the eleventh transistor M11 and a twelfth transistor M12.

A first electrode of the eleventh transistor M11 is coupled to the pixel circuit 16 at the fourth node N4 of the pixel circuit 16, or to the repair circuit 17 via the coupling portion 18, and a second electrode of the eleventh transistor M11 is coupled to the anode electrode of the OLED. A gate electrode of the eleventh transistor M11 is coupled to the emission control line E. The eleventh transistor M11 is turned off when the emission control signal is supplied to the emission control line E, so as to block the driving current from being supplied to the OLED. The eleventh transistor M11 is turned on when the emission control signal is not supplied to the emission control line E, so as to transmit the driving current from the pixel circuit 16 or the repair circuit 17 to the OLED.

A first electrode of the twelfth transistor M12 is coupled to a coupling node between the eleventh transistor M11 and the OLED, and a second electrode and a gate electrode of the twelfth transistor M12 is coupled to the first control line CL1 so as to be diode-coupled. The twelfth transistor M12 initializes the voltage at the anode electrode of the OLED as a voltage corresponding to the low voltage of the first control signal. In this case, the twelfth transistor M12 is diode-coupled, and thus a voltage, which is greater than the low voltage of the first control signal by the threshold voltage of the twelfth transistor M12, is applied to the anode electrode of the OLED. In order to stably initialize the voltage at the anode electrode of the OLED, the voltage applied to the anode electrode of the OLED may be set as a voltage lower than that of the data signal. However, the present development is not limited to having a diode-coupled twelfth transistor M12. In some embodiments, the twelfth transistor M12 may be coupled to the initialization power source Vint, so as to set the voltage at the anode electrode of the OLED as the voltage of the initialization power source Vint.

Hereinafter, a driving method of the OLED display device of FIGS. 1 and 2 will be described with reference to FIG. 3.

The scan driver 20 supplies a high-voltage emission control signal to the emission control line E during a first period t1 and a second period t2. The first and second periods t1 and t2 may be described as the non-emission period of the pixels 15 in frame 1F. In the non-emission period, the transistors in the pixel circuit 16 receiving the emission control signal are turned off. The supply of the emission control signal is stopped in a third period t3 and a fourth period t4, occurring subsequent to the first and second periods t1 and t2, which begin the emission period. In the emission period, so that the transistors are turned on. The scan driver 20 progressively supplies a scan signal to the scan lines S1 to Sn during the fourth period t4. Here, unlike the emission control signal, the scan signal is set to a voltage, e.g., a low voltage, at which the transistors receiving the scan signal are turned on.

The control driver 30 supplies a first control signal to the first control line CL1 during the first period t1, and supplies a second control signal to the second control line CL2 during the second period t2. Here, each of the first and second control signals is set to a voltage, e.g., a low voltage, at which the transistors receiving the control signal are turned on. In some embodiments, the control driver 30 may supply the first control signal to the first control line CL1 during a first period t1 in frame 1F, and may supply the second control signal to the second control line CL2 during the second period t2 occurring subsequent to the first period t1.

The switching unit 50 drives switches SW provided therein, so as to allow the output lines Do1 to Dom of the data driver 40 to be coupled to the repair lines R1 to Rm during the first to third periods t1 to t3, and to allow the output lines Do1 to Dom of the data driver 40 to be coupled to the data lines D1 to Dm during the fourth period t4.

The data driver 40 progressively outputs the voltage of the initialization power source Vint, the data signal Vdata' of the pixels 15 coupled to the repair lines R1 to Rm and the voltage of the reference power source Vref through the output lines Do1 to Dom during the first, second and third periods t1, t2 and t3 respectively, when the data driver 40 is coupled to the repair lines R1 to Rm by the switching unit 50. Accordingly, the repair lines R1 to Rm are charged with the voltage of the initialization power source Vint during the first period t1, the data signal Vdata' during the second period t2, and the voltage of the reference power source Vref during the third period t3. The repair lines R1 to Rm are floated during the fourth period t4, but maintain the voltage of the reference power source Vref by their capacitances.

The data driver 40 outputs the data signal Vdata of the pixels 15 to the output lines Do1 to Dom during the fourth period t4, when the data driver 40 is coupled to the data lines D1 to Dm by the switching unit 50. Accordingly, a voltage corresponding to the data signal Vdata is applied to the data lines D1 to Dm. In some embodiments, the data driver 40 may supply a data signal Vdata to the data lines D1 to Dm during the fourth period t4 in which the scan signal is supplied to the scan lines S1 to Sn. Here, the data driver 40 may alternately left and right data signals every frame period for the purpose of three-dimensional (3D) driving.

In some embodiments, the data driver 40 outputs a data signal Vdata' of the pixel 15 which is coupled to the repair line R during the non-emission period of the pixels 15. For example, the data driver 40 may output a data signal Vdata' of the pixel 15 coupled to the repair line R during the second period t2 in which the second control signal is supplied to the second control line CL2. In some embodiments, the data driver 40 may output the voltage of an initialization power source Vint during the first period n, and may output the voltage of a reference power source Vref during the third period t3.

First, a method of driving the OLED using the pixel circuit 16 when no defect occurs in the pixel 15, will be described. The method includes writing a data signal Vdata in the pixel circuit 16 during an emission period of the pixels, performing initialization, and performing compensation. The writing of the data signal Vdata, the initialization and the compensation are repetitively performed every frame 1F.

The pixel 15 is driven in such a manner that the data signal Vdata is written in the pixel 15 during the emission period. In some embodiments, in 3D driving, data of a right image may be written in the pixel during a period in which a left image is displayed.

In order to write the data signal Vdata, a scan signal is progressively supplied to the scan lines S1 to Sn during the fourth period t4. Accordingly, the fourth transistor M4 is turned on so that the data signal Vdata from the data line D is transmitted to the first node N1. Then, a voltage corresponding to the data signal Vdata is charged in the second capacitor C2. Meanwhile, since the second control signal maintains a high voltage during the fourth period t4, the fifth transistor M5 is turned off so that a newly written data signal Vdata has no influence on the driving current supplied to the OLED during the fourth period t4.

Subsequently, if the emission period is finished, the seventh and eleventh transistors M7 and M11 are turned off while the high-voltage emission control signal is supplied to the emission control line E, so that the supply of the driving current to the OLED is blocked, and accordingly, the OLED does not emit light.

A low-voltage first control signal is supplied to the first control line CL1 during the first period t1 in the non-emission period, the sixth, ninth and twelfth transistors M6, M9 and M12 are turned on.

When the sixth transistor M6 is turned on, the voltage of the first pixel power source ELVDD is supplied to the second node N2.

As the ninth transistor M9 is turned on, the voltage of the initialization power source Vint is supplied to the third node N3. In this case, the initialization power source Vint is set to a sufficiently low voltage at which the eighth transistor M8 is turned on, e.g., a voltage lower than that of the data signal Vdata. Accordingly, the eighth transistor M8 is set in an on-bias state.

As the twelfth transistor M12 is turned on, a voltage corresponding to the low voltage of the first control signal is supplied to the anode electrode of the OLED. The twelfth transistor M12 is diode-coupled, and therefore, a voltage which is higher than the low voltage of the first control signal by the threshold voltage of the twelfth transistor M12, is applied to the anode electrode of the OLED. The charged voltage is discharged through parasitic capacitance of the OLED, which is labeled $C_{OLED}$.

Subsequently, in period t2, as a low-voltage second control signal is supplied to the second control line CL2, the fifth and tenth transistors M5 and M10 are turned on.

As the fifth transistor M5 is turned on, the voltage of the data signal Vdata stored in the second capacitor C2 is supplied to the second node N2.

As the tenth transistor M10 is turned on, the eighth transistor M8 is diode-coupled. The voltage at the third node N3 was initialized during period t1 to the voltage of the initialization power source Vint, which is lower than that of the data signal Vdata, and hence the eighth transistor M8 is turned on.

As the eighth transistor M8 is turned on, a voltage corresponding to the data signal Vdata from the second node N2 is supplied to the third node N3 via the diode-coupled eighth transistor M8. Then, a voltage corresponding to the data signal Vdata and the threshold voltage of the eighth transistor M8 is charged in the third capacitor C3.

The voltage at the second node N2 during the second period t2 is represented by the following Equation 1 through charge sharing of the second and third capacitors C2 and C3.

$$V(N2) = \frac{C2Vdata + C3Vint}{C2 + C3} \quad \text{Equation 1}$$

Since the eighth transistor M8 is turned on by being diode-coupled, the voltage at the third node N3 is set as a voltage lower than that at the second node N2 by the value of the threshold voltage of the eighth transistor M8. The voltage at the third node N3 is represented by the following Equation 2.

$$V(N3) = \left(\frac{C2Vdata + C3Vint}{C2 + C3}\right) - |Vth| \quad \text{Equation 2}$$

In Equation 2, Vth denotes the threshold voltage of the eighth transistor M8.

That is, in order to prevent non-uniformity of image quality due to a variation in threshold voltage of the eighth transistor M8, the second period t2 is set as a compensation period in which the data signal Vdata and the voltage corresponding to the threshold voltage of the eighth transistor M8 are charged in the third capacitor C3 prior to the beginning of the emission period.

The supply of the emission control signal to the emission control line E is stopped during the emission period, which includes the third and fourth periods t3 and t4, so that the voltage of the emission control line E is set as a low voltage. Accordingly, the seventh and eleventh transistors M7 and M11 are turned on.

As the seventh transistor M7 is turned on, the first pixel power source ELVDD and the second node N2 are electrically coupled to each other. If the eleventh transistor M11 is turned on, the fourth node N4 and the OLED are electrically coupled to each other.

Accordingly, a current path forms, allowing flow of the driving current from the first pixel power source ELVDD to the second pixel power source ELVSS via the eighth and eleventh transistors M8 and M11 and to the OLED.

In this case, the amount of the driving current flowing in the OLED is controlled as an amount corresponding to the voltage at the third node N3 by the eighth transistor M8. The amount of the driving current (Ioled) is represented by the following Equation 3.

$$Ioled = \frac{1}{2}\mu C_{ox}\frac{W}{L}(ELVDD - V(N3) - |Vth|)^2 \quad \text{Equation 3}$$

$$Ioled = \frac{1}{2}\mu C_{ox}\frac{W}{L}\left(ELVDD - \left(\left(\frac{C2Vdata + C3Vint}{C2 + C3}\right) - |Vth|\right) - |Vth|\right)^2$$

$$Ioled = \frac{1}{2}\mu C_{ox}\frac{W}{L}\left(ELVDD - \frac{C2Vdata + C3Vint}{C2 + C3}\right)^2$$

In Equation 3, μ denotes a mobility of the eighth transistor M8, $C_{ox}$ denotes a gate capacitance of the eighth transistor M8, Vth denotes the threshold voltage of the eighth transistor M8, and W/L denotes a channel width/length ratio of the eighth transistor M8.

Referring to Equation 3, the driving current Ioled is generated regardless of the threshold voltage of the eighth transistor M8, and thus it is possible to compensate for the variation in threshold voltage of the eighth transistor M8.

During the fourth period t4 in the emission period, a scan signal is progressively supplied to the scan lines S1 to Sn, and the data signal Vdata is supplied to the data line D so as to be synchronized with the scan signal. As the fourth transistor M4 is turned on by applying the scan signal to scan line S, the data signal Vdata to be applied during the next emission period is charged in the second capacitor C2.

If a defect occurs in a pixel circuit 16, the pixel circuit 16 cannot supply normal driving current to the OLED. In this case, the pixel 15 is driven by the repair circuit 17. To facilitate driving by the repair circuit 17, the coupling between the pixel circuit 16 and the OLED is blocked in the cutting region 18*a* and the OLED is coupled to the repair circuit 17 via the coupling region 18*b*.

Hereinafter, the case where the OLED is driven by the repair circuit 17 will be described.

First, the eleventh transistor M11 is turned off by the high-voltage emission control signal during the non-emission period, including the first and second periods t1 and t2, so that the supply of the driving current to the OLED is blocked. Accordingly, the OLED is set in a non-emission state.

As the low-voltage first control signal is supplied to the first control line CL1 during the first period t1, the second and twelfth transistors M2 and M12 are turned on. In this case, the repair line R is coupled to the data driver 40 by the switching unit 50, and the data driver 40 outputs the voltage of the initialization power source Vint. Thus, during the first period t1, the coupling node between the gate electrode of the first transistor M1 and the first capacitor C1 is initialized with the voltage of the initialization power source Vint, turning on the first transistor M1, and charging the parasitic capacitor $C_{OLED}$. A voltage which is higher than the low voltage of the first control signal by the threshold voltage of the twelfth transistor M12 is applied to the anode electrode of the OLED.

As the low-voltage second control signal is supplied to the second control line CL2 during the second period t2 subsequent to the first period t1, the third transistor M3 is turned on. In this case, the repair line R maintains a state in which the repair line R is coupled to the data driver 40 by the switching unit 50, and the data driver 40 outputs a data signal Vdata' of the pixel 15 which is coupled to the repair circuit 17.

During the second period t2, the first transistor M1 is on-biased while being diode-coupled by the third transistor M3. Accordingly, a voltage equal to the difference between the voltage of the first pixel power source ELVDD and the threshold voltage of the first transistor M1 is applied to the coupling node between the gate electrode of the first transistor M1 and the first capacitor C1.

The data signal Vdata' is applied to the repair line R during the second period t2, and therefore, the voltage represented by the following Equation 4 is charged in the first capacitor C1.

$$V(C1) = V\text{data}' - (ELVDD - |Vth(M1)|) \quad \text{Equation 4}$$

Subsequently, as the supply of the high-voltage emission control signal supplied to the emission control line E is stopped as the third period t3 begins, the voltage of the emission control line E is dropped to a low voltage, and the eleventh transistor M11 is turned on. As the eleventh transistor M11 is turned on, there a current path is formed for driving current to flow from the first pixel power source ELVDD to the second pixel power source ELVSS via the first and eleventh transistors M1 and M11 and the OLED.

The data driver 40 outputs the voltage of the reference power source Vref during the third period t3, and the voltage of the reference power source Vref is applied to one terminal of the first capacitor C1 through the repair line R. As the voltage of the reference power source Vref is applied to the one terminal of the first capacitor C1, the voltage at the gate electrode of the first transistor M1 (Vg(M1)) is changed by the following Equation 5 through coupling of the first capacitor C1.

$$Vg(M1) = V\text{ref} - V\text{data}' + (ELVDD - |Vth(M1)|) \quad \text{Equation 5}$$

Vth(M1) denotes the threshold voltage of the first transistor M1. The driving current flowing in the OLED (Ioled) during the third period t3 is represented by the following Equation 6.

$$Ioled' = \frac{1}{2}\mu_1 C_{ox1}\frac{W1}{L1}(ELVDD - Vg(M1) - |Vth(M1)|)^2 \quad \text{Equation 6}$$

$$Ioled' = \frac{1}{2}\mu_1 C_{ox1}\frac{W1}{L1}(ELVDD - (Vref - Vdata' + ELVDD - |Vth(M1)|) - |Vth(M1)|)^2$$

$$Ioled' = \frac{1}{2}\mu_1 C_{ox1}\frac{W1}{L1}(Vdata' - Vref)^2$$

In Equation 6, $\mu_1$ denotes a mobility of the first transistor M1, $C_{ox1}$ denotes a gate capacitance of the first transistor M1, and W/L denotes a channel width/length ratio of the first transistor M1.

Referring to Equation 6, the driving current is generated regardless of the threshold voltage of the first transistor M1, and thus it is possible to compensate for a variation in threshold voltage of the first transistor M1. The driving current is determined corresponding to the voltage of the reference power source Vref, at which the current path is not formed, thereby preventing non-uniformity of image quality due to a voltage drop of the first pixel power source ELVDD.

Meanwhile, during the fourth period t4, the data driver 40 is coupled to the data line D by the switching unit 50, and a scan signal is progressively supplied to the scan lines S1 to Sn. Accordingly, the data signal Vdata to be applied in the next emission period of the other pixels (normal, or defect-free pixels) is supplied to the pixels through the data line D during the fourth period t4.

In this case, although the repair line R is floated during the fourth period t4, the voltage of the reference power source Vref is maintained by the capacitance of the repair line R, and thus the driving current represented by Equation 6 continuously flows in the OLED.

by providing the repair circuit 17 to OLED, driving current when a defect occurs in the pixel circuit 16, light with a desired luminance can be generated in a corresponding pixel 15 by the repair circuit 17, thereby improving the yield and quality of the OLED display device.

Moreover, in this embodiment, the second and third transistors M2 and M3 configured to compensate the threshold voltage of the first transistor M1 and the voltage drop of the first pixel power source ELVDD are provided together in the repair circuit 17, thereby improving the image quality of the OLED display device.

Figure 4:
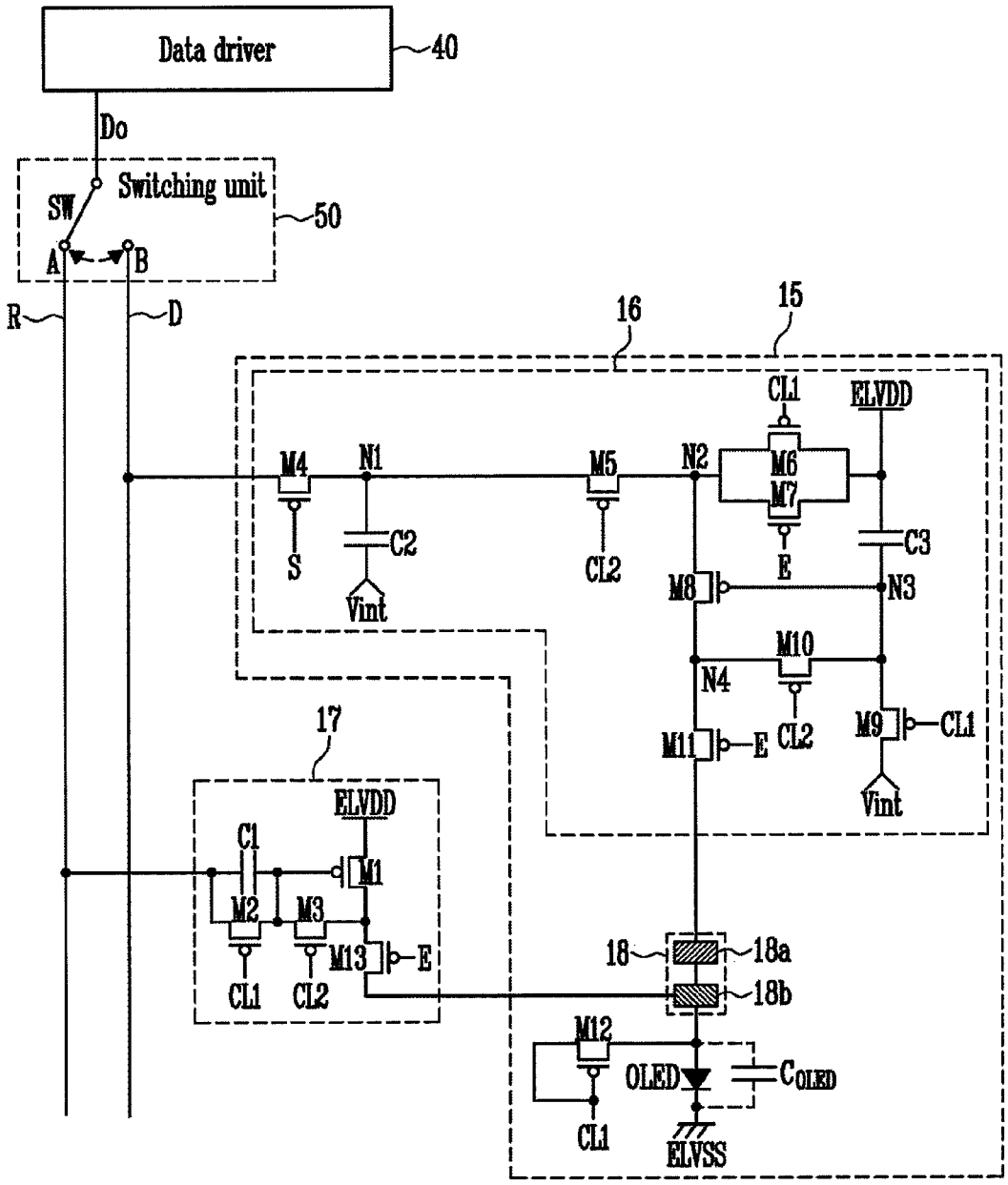
FIG. 4 is a circuit diagram illustrating an embodiment of the pixel, the repair circuit and the switching unit shown in FIG. 1.

FIG. 4 is a circuit diagram illustrating an embodiment of the pixel, the repair circuit and the switching unit shown in FIG. 1. For convenience, components identical or similar to those of FIG. 2 are designated by like reference numerals in FIG. 4, and their detailed descriptions will be omitted.

Referring to FIG. 4, the eleventh transistor M11 is located in the pixel circuit 16, and a thirteenth transistor M13 is provided in the repair circuit 17.

The eleventh transistor M11 is coupled between the fourth node N4 and the coupling portion 18, and the gate electrode of the eleventh transistor M11 is coupled to the emission control line E.

The thirteenth transistor M13 is coupled between the second electrode of the first transistor M1 and the coupling portion 18. A gate electrode of the thirteenth transistor 13 is coupled to the emission control line E.

In some embodiments, when a defect occurs in the pixel circuit 16, the coupling of the eleventh transistor M11 with the OLED is blocked. The thirteenth transistor M13 blocks the coupling between the first transistor M1 and the OLED during the non-emission period, and allows the first transistor M1 and the OLED to be coupled to each other during the emission period. The remainder of the pixel, the repair circuit and the switching unit function similar to those described elsewhere herein.

Figure 5:
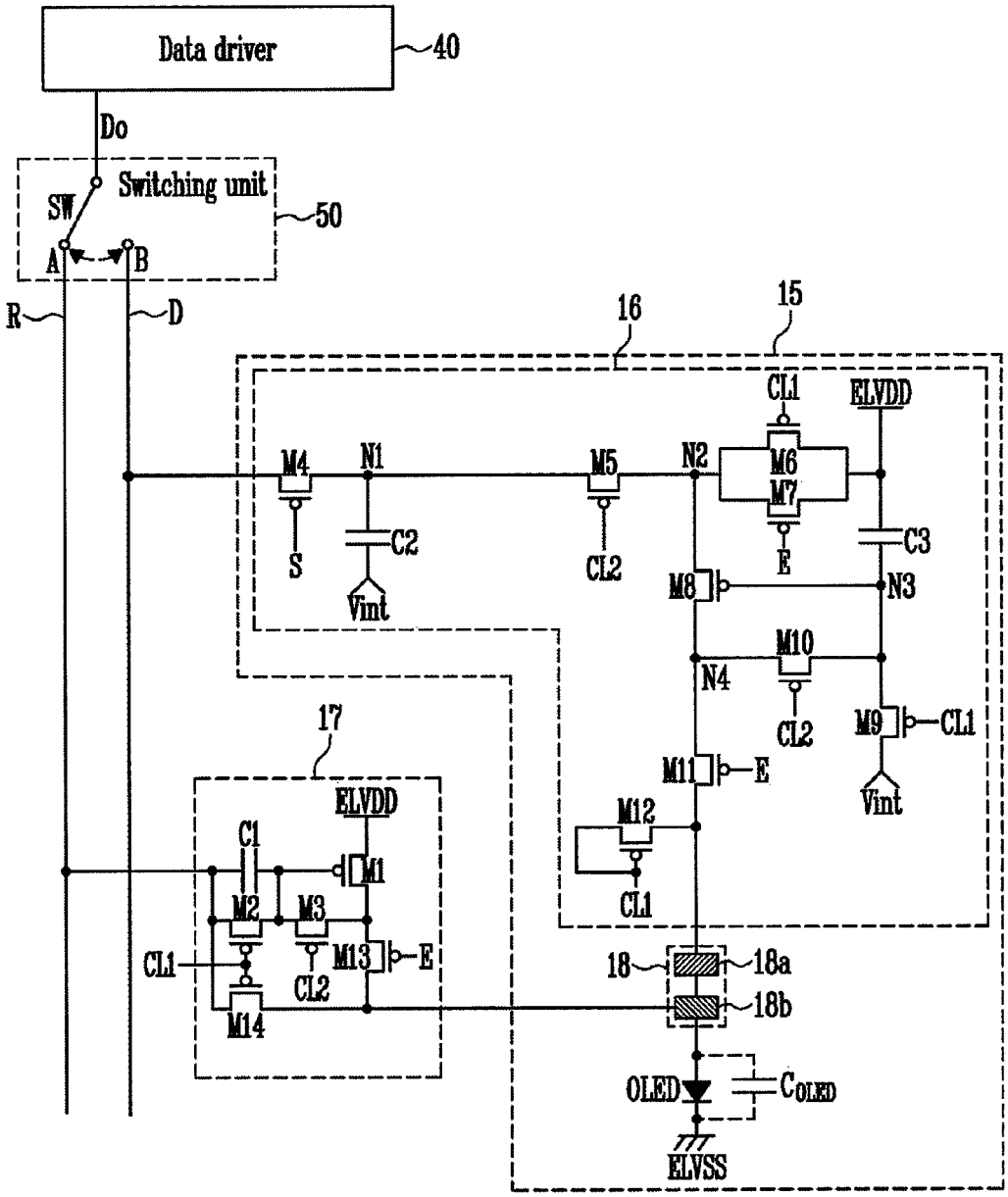
FIG. 5 is a circuit diagram illustrating an embodiment of the pixel, the repair circuit and the switching unit shown in FIG. 1.

FIG. 5 is a circuit diagram illustrating another embodiment of the pixel, the repair circuit and the switching unit shown in FIG. 1. For convenience, components identical or similar to those of FIG. 2 are designated by like reference numerals in FIG. 5, and their detailed descriptions will be omitted.

Referring to FIG. 5, the twelfth transistor M12 is included in the pixel circuit 16, and a fourteenth transistor M14 is provided in the repair circuit 17.

The twelfth transistor M12 is coupled between the second electrode of the eleventh transistor M11 and the first control line CL1. The gate electrode of the twelfth transistor 12 is coupled to the first control line CL1 so as to be diode-coupled.

The fourteenth transistor M14 is coupled between the repair line R and a coupling node between the thirteenth transistor 13 and the coupling portion 18. A gate electrode of the fourteenth transistor 14 is coupled to the first control line CL1.

That is, in the embodiment shown in FIG. 5, the coupling of the twelfth transistor M12 to the OLED is blocked when a defect occurs in the pixel circuit 16. The fourteenth transistor M14 is turned on during the first period t1 in the non-emission period so as to transmit the voltage of the initialization power source Vint, to the anode electrode of the OLED.

Thus, the voltage charged in the parasitic capacitor $C_{OLED}$ of the OLED is discharged by the voltage of the initialization power source Vint during the first period t1. The remainder of the pixel, the repair circuit and the switching unit function similar to those described elsewhere herein.

Figure 6:
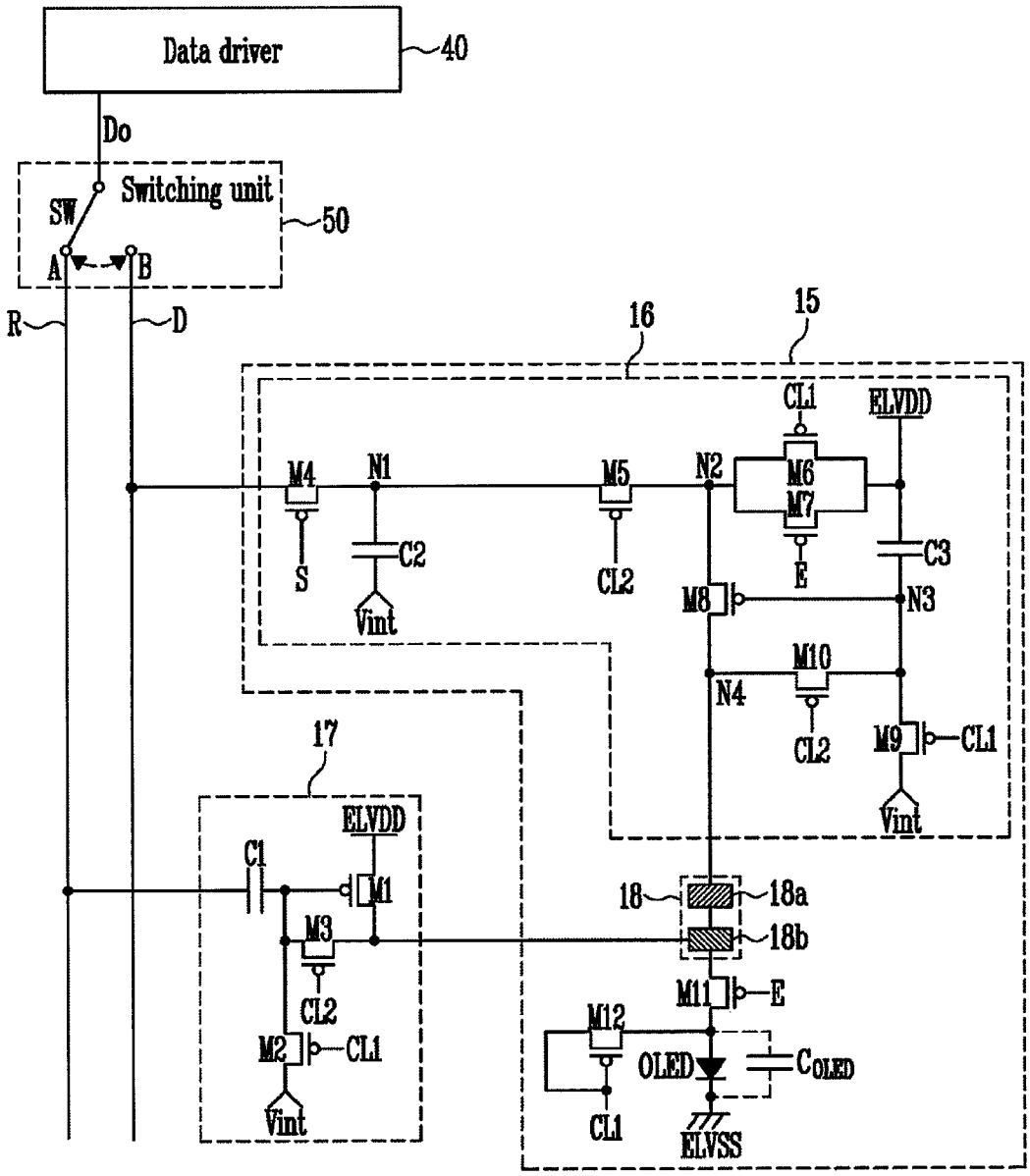
FIG. 6 is a circuit diagram illustrating an embodiment of the pixel, the repair circuit and the switching unit shown in FIG. 1.
Figure 7:
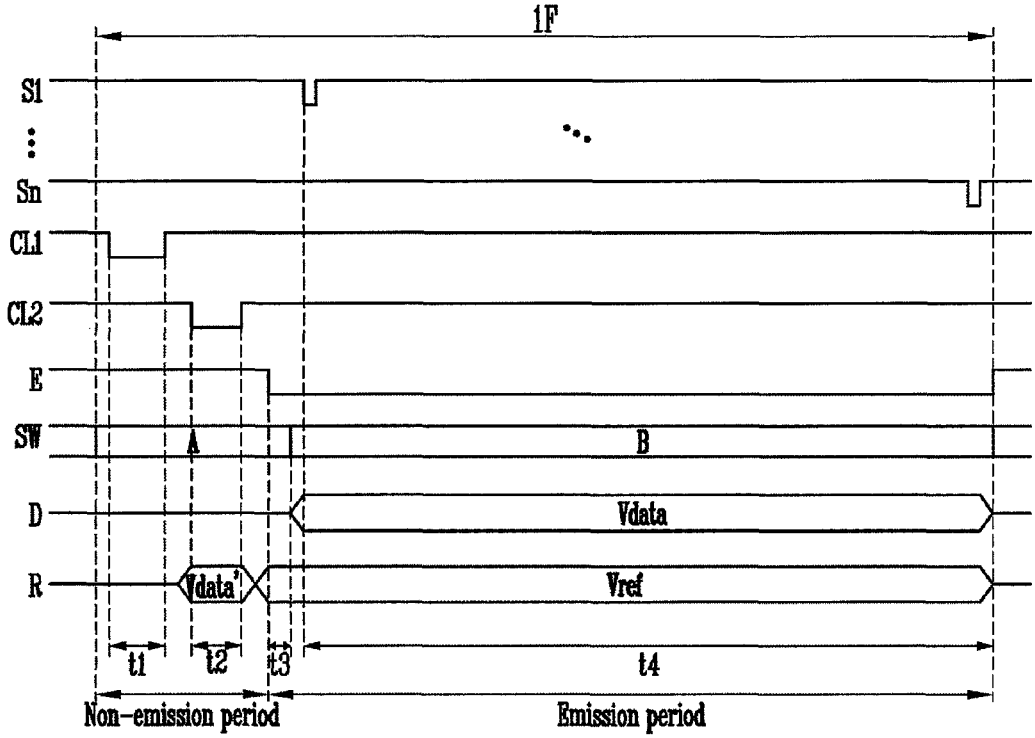
FIG. 7 is a waveform diagram illustrating a driving method of the pixel, the repair circuit and the switching unit shown in FIG. 6.

FIG. 6 is a circuit diagram illustrating another embodiment of the pixel, the repair circuit and the switching unit shown in FIG. 1. FIG. 7 is a waveform diagram illustrating a driving method of the pixel, the repair circuit and the switching unit, shown in FIG. 6. For convenience, in FIGS. 6 and 7, components identical or similar to those of FIGS. 2 and 3 are designated by like reference numerals, and their detailed descriptions will be omitted.

Referring to FIGS. 6 and 7, the second electrode of the second transistor M2, is coupled to the initialization power source Vint. The second transistor M2 is turned on by the first control signal supplied from the first control line CL1 during the first period t1 so as to transmit the voltage of the initialization power source Vint to the coupling node between the gate electrode of the first transistor M1 and the first capacitor C1.

The second transistor M2 directly couples the coupling node between the gate electrode of the first transistor M1 and the first capacitor C1 to the initialization power source Vint. Thus, the voltage of the initialization power source Vint is not supplied to the repair line R through the data driver 40 during the first period t1. The remainder of the pixel, the repair circuit and the switching unit function similar to those described elsewhere herein.

In some embodiments, the OLED display device may be classified into a passive matrix type organic light emitting diode display (PMOLED) device or an active matrix type organic light emitting diode display (AMOLED) device according to the method of driving an organic light emitting diode.

The AMOLED device includes a plurality of scan lines, a plurality of data lines, and a plurality of pixels coupled to the scan lines and the data lines so as to be arranged in a matrix form.

Each pixel includes an organic light emitting diode, and a pixel circuit configured to supply, to the organic light emitting diode, driving current corresponding to a data signal.

Generally, the pixel circuit includes a driving transistor configured to control driving current supplied to the organic light emitting diode, a switching transistor configured to transmit a data signal to the driving transistor, and a storage capacitor configured to maintain the voltage of the data signal. The pixel circuit may further include a larger number of electronic devices including a transistor configured to compensate for the threshold voltage of the driving transistor and a transistor configured to transmit an initialization voltage to the pixel circuit.

The AMOLED device has low power consumption, and thus the application field of the AMOLED device has been extended.

In the AMOLED device, a defect may occur in a pixel circuit including a plurality of transistors and a capacitor, thereby lowering the yield of the AMOLED device.

In the OLED display devices and the driving method thereof described herein, the OLED display device has a repair circuit including a first transistor, which supplies, to an organic light emitting diode, driving current corresponding to a data signal, in place of a pixel circuit when a defect occurs in the pixel circuit. Accordingly, light with a desired luminance can be generated in a corresponding pixel even when the defect occurs in the pixel circuit, thereby improving the yield of the OLED display device.

Further, in the OLED display device and the driving method thereof according to the embodiments of the present invention, transistors configured to compensate for the threshold voltage of the first transistor and a voltage drop of a first pixel power source are provided together in the repair circuit, thereby improving the image quality of the OLED display device.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode display device, comprising:

a plurality of pixels positioned at intersection portions of scan lines and data lines, the plurality of pixels each having a pixel circuit and an organic light emitting diode coupled to the pixel circuit;

a scan driver configured to supply a scan signal to the scan lines and supply an emission control signal to a common emission control line coupled to the pixels;

a control driver configured to supply a first control signal to a first common control line coupled to the pixels and supply a second control signal to a second common control line commonly coupled to the pixels;

a data driver configured to supply a data signal to the data lines;

repair lines arranged in parallel to the data lines;

repair circuits coupled to the repair lines, the repair circuits each having an output terminal coupled to an organic light emitting, diode in one or more corresponding pixels, wherein each repair circuit includes:

a first transistor having a first electrode thereof coupled to a first pixel power source, and a second electrode thereof coupled to the output terminal;

a first capacitor coupled between a gate electrode of the first transistor and a repair line;

a second transistor having a first electrode thereof coupled to a coupling node between the gate electrode of the first transistor and the first capacitor, a second electrode thereof coupled to the repair line, and a gate electrode thereof coupled to the first control line; and a third transistor having a first electrode thereof coupled to the coupling node between the gate electrode of the first transistor and the first capacitor, a second electrode thereof coupled to the second electrode of the first transistor, and a gate electrode thereof coupled to the second control line; and a switching unit configured to selectively couple the data driver to the repair lines, or the data lines.

2. The organic light emitting diode display device of claim 1, wherein the organic light emitting diode provided in each pixel is configured to the selectively coupled to the pixel circuit or a corresponding repair circuit via a coupling portion.

3. The organic light emitting diode display device of claim 1, wherein the pixel circuit provided in each pixel includes:

a fourth transistor having a first electrode thereof coupled to a data line, a second electrode thereof coupled to a first node, and a gate electrode thereof coupled to a scan line;

a second capacitor coupled between the first node and the initialization power source;

a fifth transistor having a first electrode thereof coupled to the first node, a second electrode thereof coupled to a second node, and a gate electrode thereof coupled to the second control line;

a sixth transistor having a first electrode thereof coupled to the first pixel power source, a second electrode thereof coupled to the second node, and a gate electrode thereof coupled to the first control line;

a seventh transistor having a first electrode thereof coupled to the first pixel power source, a second electrode thereof coupled to the second node, and a gate electrode thereof coupled to the emission control line;

a third capacitor coupled between the first pixel power source and a third node;

an eighth transistor having a first electrode thereof coupled to the second node, a second electrode thereof coupled to a fourth node, and a gate electrode thereof coupled to the third node;

a ninth transistor having a first electrode thereof coupled to the third node, a second electrode thereof coupled to the initialization power source, and a gate electrode thereof coupled to the first control line; and a tenth transistor having a first electrode thereof coupled to the fourth node, a second electrode thereof coupled to the third node, and a gate electrode thereof coupled to the second control line.

4. The organic light emitting diode display device of claim 3, wherein the organic light emitting diode provided in each pixel is configured to be selectively coupled to a pixel circuit in the corresponding pixel or a corresponding repair circuit via a coupling portion, and wherein each pixel includes:

an eleventh transistor coupled between the coupling portion and the organic light emitting diode, the eleventh transistor having a gate electrode coupled to the emission control line; and a twelfth transistor coupled between the first control line and a coupling node between the eleventh transistor and the organic light emitting diode, the twelfth transistor having a gate electrode coupled to the first control line so as to be diode-coupled.

5. The organic light emitting diode display device of claim 4, wherein the control driver supplies a first control signal during a first period in a frame, and supplies a second control signal during a second period which is subsequent to the first period.

6. The organic light emitting diode display device of claim 5, wherein the scan driver is configured to turn off the seventh and eleventh transistors to be turned off by supplying the emission control signal during the first and second periods, and is further configured to stop the emission control signal during a third period, which is subsequent to the first and second periods, and to progressively supply a scan signal to the scan lines during a fourth period which is subsequent to the third period.

7. The organic light emitting diode display device of claim 6, wherein the switching unit is configured to couple the output lines of the data driver to the repair lines during at least the second and third periods, and is configured to couple the output lines to the data lines during the fourth period.

8. The organic light emitting diode display device of claim 7, wherein the data driver is configured to output a data signal of the pixel coupled to the repair line during the second period, and a reference voltage during the third period.

9. The organic light emitting diode display device of claim 7, wherein the data driver is configured to output the data signal during the fourth period.

10. The organic light emitting diode display device of claim 7, wherein the switching unit is further configured to couple the output lines of the data driver to the repair lines during the first period.

11. The organic light emitting diode display device of claim 10, wherein the data driver outputs the voltage of the initialization power source during the first period.

12. The organic light emitting diode display device of claim 3, wherein the organic light emitting diode provided in each pixel is configured to be selectively coupled to a pixel circuit in the corresponding pixel or a corresponding repair circuit via a coupling portion, wherein the pixel circuit further includes an eleventh transistor coupled between the fourth node and the coupling portion, the eleventh transistor having a gate electrode coupled to the emission control line, and wherein the repair circuit further includes a thirteenth transistor coupled between the second electrode of the first transistor and the coupling portion, the thirteenth transistor having a gate electrode coupled to the emission control line.

13. The organic light emitting diode display device of claim 12, wherein each pixel further includes a twelfth transistor coupled between the first control line and a coupling node between the coupling node and the organic light emitting diode, the twelfth transistor having a gate electrode coupled, to the first control line so as to be diode-coupled.

14. The organic light emitting diode display device of claim 12, wherein the pixel circuit further includes a twelfth transistor coupled between the second electrode of the eleventh transistor and the first control line, the twelfth transistor having a gate electrode coupled to the first control line so as to be diode-coupled, and wherein the repair circuit further includes a fourteenth transistor coupled between the repair line and a coupling node between the coupling portion and the thirteenth transistor, the fourteenth transistor having a gate electrode coupled to the first control line.

15. The organic light emitting diode display device of claim 1, wherein each of the repair circuits corresponds to one of the pixels and is arranged adjacent to the corresponding pixels.

16. The organic light emitting diode display device of claim 1, wherein the repair circuits are arranged so that each of the repair circuits corresponds to a plurality of pixels.

17. A method of driving an organic light emitting diode display in which a defect occurs in a pixel circuit, the method comprising:

cutting off a current path between the repair circuit and the organic light emitting diode by supplying an emission control signal during a non-emission period of the pixel;

supplying the voltage of an initialization power source to a gate electrode of a first transistor in a repair circuit corresponding to the pixel circuit by supplying a first control signal to a gate electrode of a second transistor in the repair circuit, wherein supplying the first control signal occurs during a first period;

supplying and storing a data signal of the pixel into the repair circuit by supplying a second control signal to a third transistor in the repair circuit during a second period, which subsequent to the first period; and forming a current path between the repair circuit and the organic light emitting diode by stopping the supply of the emission control signal during an emission period of the pixel; and supplying a source reference voltage to the repair circuit during a third period, the third period being part of the emission period.

18. The method of claim 17, wherein data signals are supplied to the pixels while a scan signal is progressively supplied to the scan lines during a fourth period, which is subsequent to the third period and is part of the emission period.

* * * * *